US009453314B2

(12) United States Patent
Cadogan et al.

(10) Patent No.: US 9,453,314 B2
(45) Date of Patent: Sep. 27, 2016

(54) DEPLOYABLE FLEXIBLE FLOOD MITIGATION WALL

(71) Applicant: ILC DOVER LP, Frederica, DE (US)

(72) Inventors: David Phillip Cadogan, Middletown, DE (US); Jonathan Michael Hinkle, Middletown, DE (US); Charles Ralph Sandy, Camden, DE (US); Carl Frank Knoll, Jr., Felton, DE (US)

(73) Assignee: ILC DOVER LP, Frederica, DE (US)

( * ) Notice: Subject to any disclaimer, the term of this patent is extended or adjusted under 35 U.S.C. 154(b) by 0 days.

(21) Appl. No.: 14/490,058

(22) Filed: Sep. 18, 2014

(65) Prior Publication Data

US 2016/0083918 A1 Mar. 24, 2016

(51) Int. Cl.

| | |
|---|---|
| ***E02B 3/10*** | (2006.01) |
| ***E06B 9/06*** | (2006.01) |
| *E06B 9/00* | (2006.01) |

(52) U.S. Cl.

CPC ..... *E02B 3/102* (2013.01); *E06B 9/0692* (2013.01); *E02B 3/106* (2013.01); *E06B 2009/007* (2013.01)

(58) Field of Classification Search

CPC ..... E02B 7/00; E02B 7/20; E02B 3/10; E02B 3/106; E02B 3/102

USPC ..... 405/91, 98, 103–107, 109, 110, 112, 405/114, 115; 52/169.14

See application file for complete search history.

(56) References Cited

U.S. PATENT DOCUMENTS 4,136,995 A * 1/1979 Fish ..... E02B 7/005 210/162

4,321,774 A 3/1982 Fish (Continued)

FOREIGN PATENT DOCUMENTS

DE 3527100 A1 * 2/1987

DE 102007040744 A1 * 3/2009

(Continued)

OTHER PUBLICATIONS

Machine Translation of DE 102012005329a1; dated Feb. 4, 2016; 6 pages.*

(Continued)

*Primary Examiner* — Sunil Singh

(74) *Attorney, Agent, or Firm* — Polsinelli PC

(57) ABSTRACT

A novel design and construction method for the creation of a deployable flexible flood mitigation wall manufactured from textile and membrane materials. The flexible flood mitigation wall system comprises a textile/membrane wall and support posts configured to be movable between a stowed position and a deployed position and wherein, in the deployed position, the wall forms a leak-free barrier against flood water or other fluids. A series of posts that are manually deployed is used to support the fabric wall when hydrostatically challenged, and transfer loads to the ground. The wall is stored at the point of use in a surface box or trench box and keeps the loading from the flood water off the building, structure or equipment being protected. The flexible flood mitigation wall can be configured for use in many applications including entire buildings, building entrances, transit system passages such as ventilation shafts or elevator shafts, windows, stairwells, and other openings that can be threatened by flooding. It can be continuous such that it surrounds structures such as buildings and power substations, homes, or segmented, such that it can be used to seal openings of all kinds including human or vehicle doorways. It can be tailored to fit any opening and water height.

27 Claims, 5 Drawing Sheets

(56) References Cited

U.S. PATENT DOCUMENTS

| | | | | | |
|---|---|---|---|---|---|
| 4,375,929 | A | * | 3/1983 | Clark | E04H 9/145 405/114 |
| 4,458,456 | A | * | 7/1984 | Battle | E04H 9/145 405/115 |
| 4,787,774 | A | * | 11/1988 | Grove | E02B 7/44 405/101 |
| 5,460,462 | A | * | 10/1995 | Regan | E02B 3/104 405/104 |
| 5,645,373 | A | | 7/1997 | Jenkins | |
| 5,988,946 | A | * | 11/1999 | Reed | 405/115 |
| 6,029,405 | A | * | 2/2000 | Wood | E04H 3/14 52/169.14 |
| 6,216,399 | B1 | | 4/2001 | Belarbi | |
| 6,425,213 | B1 | | 7/2002 | Lachapelle | |
| 6,425,707 | B1 | | 7/2002 | Baxter | |
| 6,443,655 | B1 | | 9/2002 | Bennett | |
| 6,460,299 | B1 | | 10/2002 | Burrow | |
| 6,551,025 | B2 | | 4/2003 | Dery | |
| 6,991,403 | B1 | | 1/2006 | Hendee | |
| 7,214,005 | B1 | | 5/2007 | Davis | |
| 7,614,825 | B2 | | 11/2009 | Kroger | |
| 7,690,865 | B1 | | 4/2010 | Stewart et al. | |
| 7,712,998 | B2 | | 5/2010 | Salemie | |
| 7,976,240 | B2 | | 7/2011 | Mun | |
| 2004/0098937 | A1 | | 5/2004 | Blake et al. | |
| 2010/0310315 | A1 | | 12/2010 | James | |
| 2014/0369760 | A1 | * | 12/2014 | Venton | E02B 7/22 405/114 |

FOREIGN PATENT DOCUMENTS

| | | | | |
|---|---|---|---|---|
| DE | 102007037476 | A1 | | 4/2009 |
| DE | 102012005329 | A1 | * | 9/2013 |
| EP | 1179641 | A2 | * | 2/2002 |
| EP | 1383963 | B1 | | 10/2006 |
| FR | 2876716 | A1 | * | 4/2006 |
| WO | WO 2014/012526 | A1 | | 1/2014 |

OTHER PUBLICATIONS

Machine Translation of EP document '641; dated Feb. 4, 2016; 7 pages.*

Search Report Dated January 29, 2015.

* cited by examiner

DEPLOYABLE FLEXIBLE FLOOD MITIGATION WALL

FIELD OF THE INVENTION

The present invention relates to a Flexible Flood Mitigation Device system that is scalable in size, shape, and orientation to a wide variety of applications. The invention can be used to seal part or all of an opening from flood water or other fluid threats, or completely surround a building or structure for protection.

BACKGROUND OF THE INVENTION

Flooding events can be precipitated by natural and manmade inputs. These events can be particularly challenging for buildings and infrastructure located at or near a body of water. Transportation systems or buildings in these areas that are below the normal waterline are particularly vulnerable. Severe storms with high tidal surges or flash floods, rising sea levels, and seismic activity are some of the challenges posed by nature. Accidents, terrorism, and mechanical failures are manmade threats that can cause flooding, or magnify flooding from natural events.

Many subway and vehicular tunnels that operate below waterline around the world have experienced flooding. Countless buildings and structures such as power substations have also experienced flooding. Hurricane Sandy was particularly devastating to New York City in 2012 because a significant portion of the subway system was flooded and economic losses were unprecedented. Water entrance points included subway portals, stairwell entrance points, ventilation shafts, emergency exits, and elevator shafts. Vehicular tunnels were also flooded, as well as many buildings. This was one of the worst flooding events in history, but it was just one in a string of events in subway systems in major cities around the world.

There are many types of flood mitigation wall systems available commercially. This includes sand bags, inflatable walls, deployable mechanical walls, and flood doors. Most of these devices are stored remotely and transported to the point of use when needed. This requires the user to have extensive logistical plans and training in place to provide effective protection. Mechanical systems such as rigid doors that are stored at point-of-use often require significant modification to the infrastructure during installation, a considerable amount of storage space for concealment, frequent maintenance, and are costly to install. Because of this, they are often found to be unacceptable in numerous applications.

Textile and membrane based Flexible Flood Mitigation Walls offer significant benefits over the existing wall devices. Most notable is the ability to pack the wall system into a small volume for point-of-use storage. This not only allows the Flexible Flood Mitigation Wall to be stored in a small volume that is compatible with space available, but it also minimizes the modifications required on the infrastructure to install it. The membrane wall itself is shaped to minimize stress in the material (governed by thin-walled pressure vessel equations, specifically pressure and radius). The wall is deployed by first removing the cover over its storage trench which is in-front of, or surrounding the opening/property to be protected. The posts, which are stored in the trench with the membrane wall, are lifted and positioned in receivers. The fabric wall, which is attached to the trench along its base, is then raised and attached to the posts. When water, waves, and floating debris impact the wall, the loads are transferred from the fabric into the posts and then into the ground. The posts can be straight beams or can be buttressed for additional bending strength and control of loads in the trench. The flexible fabric wall can be constituted of one or several layers or different types of materials to provide protection from threats of all kinds including water pressure, wave action, floating debris impact, or even chemical threats.

The Flexible Flood Mitigation Wall can follow any perimeter shape with positive and negative recesses, angular changes, or grade changes. It can be continuous and completely surround a structure, or simply bridge an opening and seal against the sides of the opening via the addition to sealing materials on the posts that abut the buildings.

The Flexible Flood Mitigation Wall can also be used as a containment device that keeps a fluid inside an area and prevents its escape. This could be in the form of a deployable wall around a location where hazardous materials are used and spills are required to be contained.

SUMMARY OF THE INVENTION

The Flexible Flood Mitigation Device is deployable wall that leverages the unique advantages of textile & membrane materials to advance the state of the art in flood mitigation devices.

The Flexible Flood Mitigation Device is comprised of a textile and membrane wall, posts that support the wall when deployed, a base plate for mounting the post receivers and wall, and a trench with a protective cover.

The flexible wall is folded and stored in the trench along with the posts until a potential flooding event is identified. At this time, the trench cover is removed, the posts are raised and inserted into their receivers, and the flexible wall is lifted and attached to the posts. When deployed, the wall will prevent the passage of water under significant hydrostatic pressure (from zero to approximately ten feet of pressure head). The wall terminates under a clamping bar and seal that are located at the base of the trough on a mounting plate. A deadman assembly can be used in conjunction with the clamp to prevent pull-out of the flexible wall when under load. After the event is over, the wall is detached from the posts, folded and stored back in the trench. The covers are reinstalled over the trench to protect the system. The covers can be applied with tamperproof fasteners or hinges if desirable, and can also be load rated to withstand traffic.

The wall assembly is stored below ground at the point of use and is simple to deploy, so users can deploy their flood mitigation system quickly and as close to the flooding event as possible. This is important in high traffic applications such as transit systems or businesses, where down-time equates to lost revenue. Point of use storage excludes the potential for lost parts over time when items are stored remotely. It also permanently fixes the seal of the fabric wall to the ground such that a high reliability system with no leakage is ensured. Most deployable systems cannot seal effectively to the ground because of surface roughness, cracks, and undulations in the surface, and therefore leak. This often results in the need for pumps to remove leakage of the water, and therefore power, which is often unavailable in storm and flooding events.

The trench and wall assembly can be designed to form a perimeter around a structure of any shape, and can include concave and convex features. It can be formed on slopes, across curbs, or can be placed above ground in the form of a bench. The trench, usually formed in concrete to react the loads from water impinging on the deployable wall, can be any shape or size to accommodate short or tall walls. If the reaction loads on the trench from the post loads become prohibitive on the trench then a deployable buttress can be added to the posts. The buttress will direct loads to the landing point of the buttress and greatly reduce the loads induced on the trench. The spacing of the posts can also be altered to increase the strength of the wall when spaced close together, or reduce the cost of the wall by spreading them apart.

The flexible wall assembly can prevent impingement of the wall, and thus force of the water, on the structure it is protecting (glass windows, etc.). This can be done by positioning the trench away from the structure, or by angling the posts away from the structure if the trench is near the structure. Independent flexible members (rope, cable, etc.) can be strung from the post top to the trench such that a channel or large series of belt loops is created, such that the wall will be captive and can be easily deployed in wind.

The flexible wall system can abut and seal against structures such as buildings, walls, or doorways. This is accomplished by adding a seal between the last post and the building. The flexible wall can also have interruptions so passageways can be created that will allow the flow of pedestrian traffic until the last possible minute when sealing the wall is required. This is possible because the wall can start or stop at columns through the use of an overlapping wall sealing system. This is comprised of the flexible wall with a deadman assembly, being captured between two abutting posts. The deadman is a flexible assembly that is larger than the gap between the posts and therefore will not slip between the posts and is therefore permanently captured. Face seals on the posts in this area prevent leakage past the joined wall sections.

A second aspect of the invention is the use of a the same, or similar but less structural version, to be used as a protective barrier against human or vehicular traffic flow, wind, flying objects, etc. The functionality of the system is the same, but the forces on the system are potentially lower in these cases so different materials could be used.

DETAILED DESCRIPTION OF THE PREFERRED EMBODIMENTS

Figure 1:
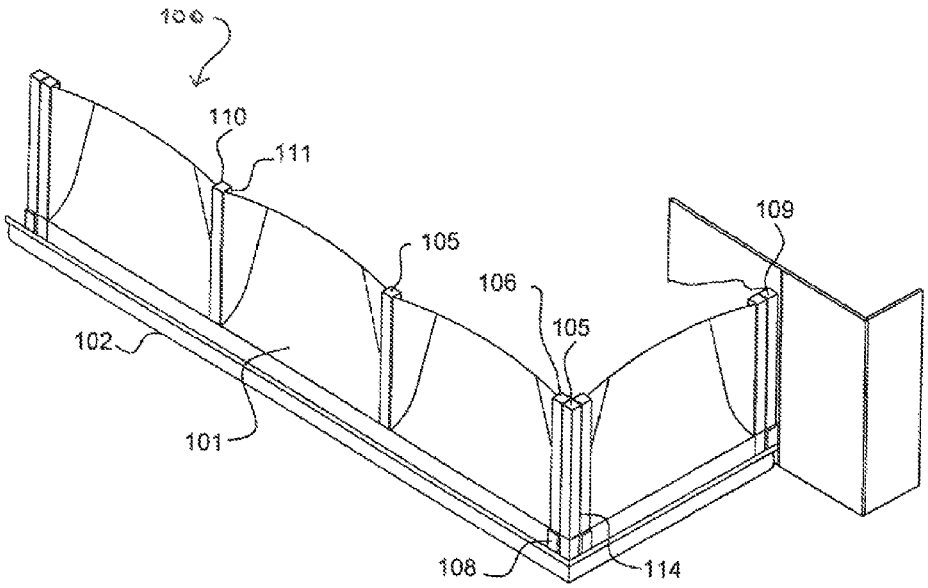
FIG. 1 illustrates the assembly with a corner, and the flexible wall deployed
Figure 2:
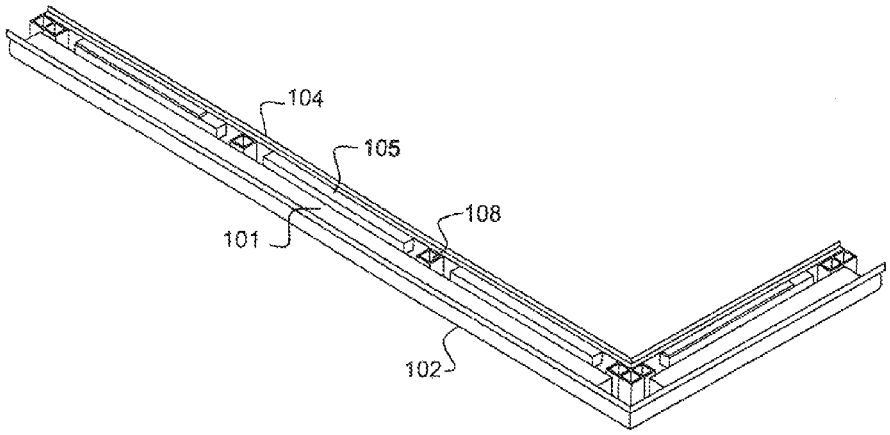
FIG. 2 illustrates the assembly with a corner, and the flexible wall packed with the cover removed
Figure 3A:
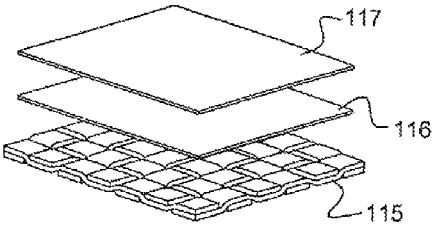
FIGS. 3A-3D illustrate several potential constructions of the fabric wall
Figure 3B:
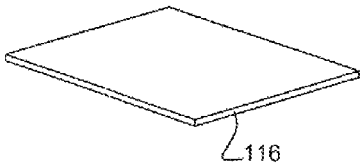
Figure 3C:
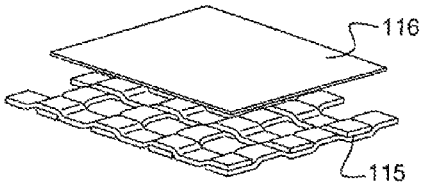
Figure 3D:
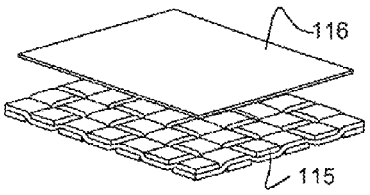

FIG. 1 illustrates a perspective view of a Deployable Flexible Flood Wall with the wall in the deployed position 100 according to an embodiment of the present invention. FIG. 2 illustrates the Deployable Flexible Flood Wall 100 in its stowed condition with the cover removed. FIGS. 3 through 8 respectively illustrate detailed views of critical features of the Deployable Flexible Flood Wall 100. The Deployable Flexible Flood Wall is also referred to as the Flex-Wall.

As shown in FIGS. 1, 2, 5, 6 and 7, the Deployable Flexible Flood Wall 100 is comprised of a textile & membrane flexible wall 101, a trench 102, a sealing clamp 103, a mounting plate 104, a post 105, a clamping post 106, a buttress 107, a receiver 108, a wall seal 109, a tether 110, an anchor 111, and cover 112.

The flexible wall 101 is folded and stored in the trench 102 and can be moved from a stowed to a deployed position and visa-versa. The flexible wall 101 is attached to the mounting plate 104 with the sealing clamp 103, and possibly the use of a deadman 113 termination to the flexible wall 101, to prevent pull-out from the sealing clamp 103. The sealing clamp 103 provided a leak-free seal between the flexible wall 101 and the mounting plate 104. A gasket seal 114 is situated between the mounting plate 104, and the trench 102 to provide a leak-free seal. In order to deploy the flexible wall 101, the cover 112 on the trench 102 must first be removed. The posts 105 are lifted or rotated into receivers 108 that are fixed to the mounting plate 104. The flexible wall 101 is then lifted vertically and attached to the posts 105 via a tether 110 on the flexible wall 101, and an anchor 111 on the post 105 Water impinging on the flexible wall 100 drives the load into the posts 105, and then into the receivers 108 where they are reacted by the trench 102. The flexible wall 101 can be stowed in a number of ways including rolling or folding.

The flexible wall 101 can be terminated at a post 105 by clamping it between the post 105 and the clamping post 106. A gasket seal 114 on the clamping post 106 will seal the flexible wall 101 to prevent water pass by. A deadman 113 termination can be added to the ends of the wall to prevent pull-out when the wall is loaded. The clamping posts 106 can be located on any side of the post 105 for convenience. This clamping arrangement can be used to terminate the deployable flexible flood wall 100 against a building or structure, create a doorway along the span, create a join at a corner, or any other configuration required where the flexible wall 101 needs to be terminated or two flexible walls 101 joined in a leak-free assembly, The post 105 can be fitted with a fixed or removable wall seal 109 to form a leak-free seal between the deployable flexible flood wall 100 and a building or structure.

As seen in various of the drawing FIGS. 1, 2, 6 and 7, at least the lower end of the posts 105 have a quadrilateral exterior surface on at least a lower end of the post 105 to fit within a corresponding quadrilaterally shaped receiver 108.

Figure 4:
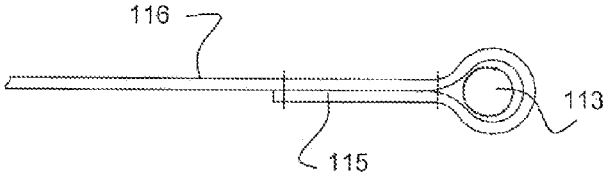
FIG. 4 illustrates the termination assembly of the flexible wall
Figure 5:
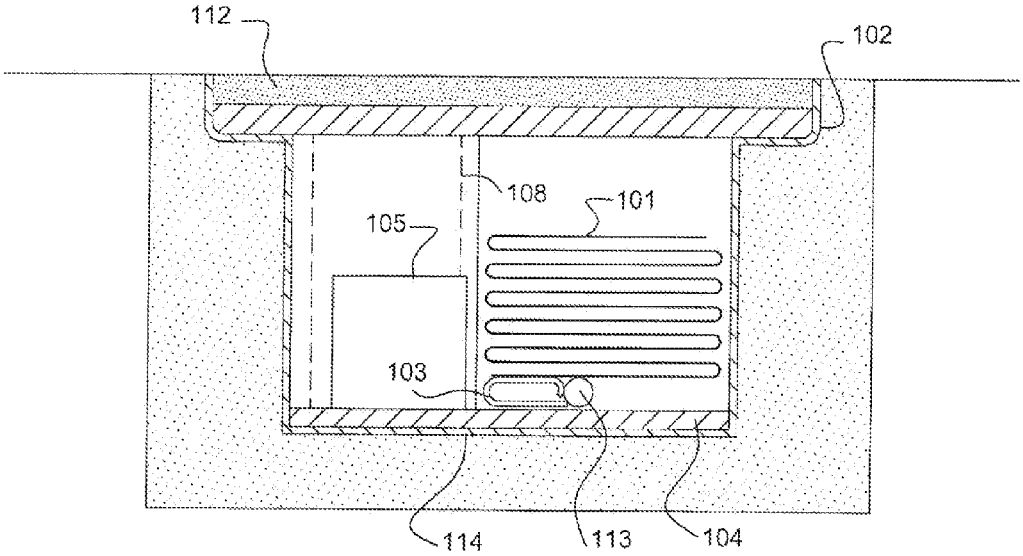
FIG. 5 illustrates the assembly in the packed state
Figure 6:
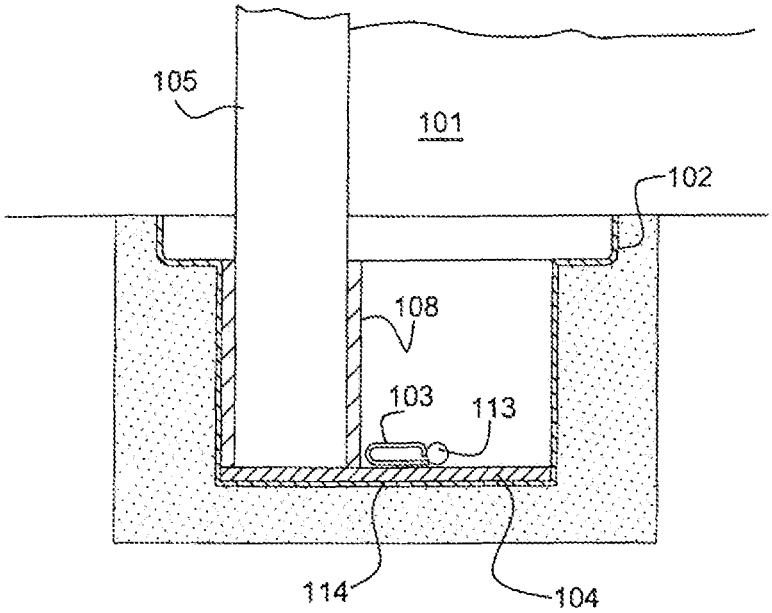
FIG. 6 illustrates the assembly in the deployed position
Figure 7:
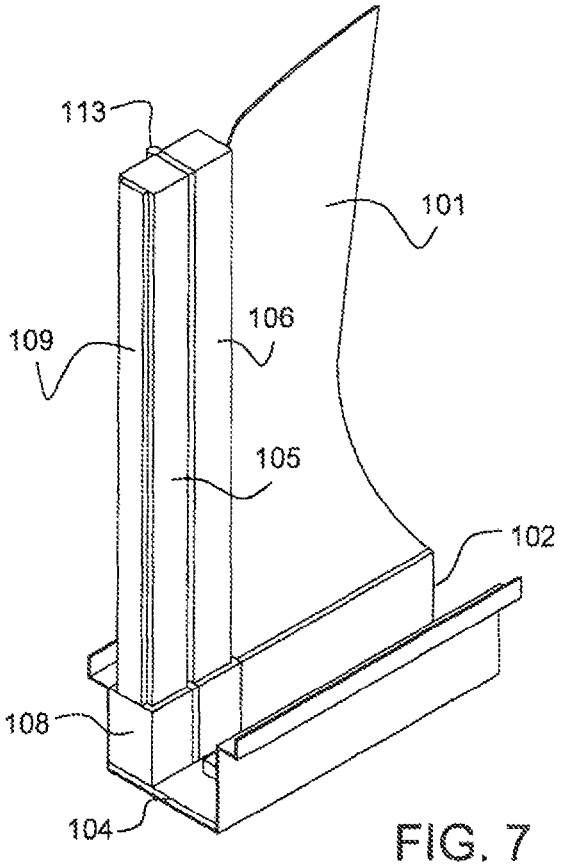
FIG. 7 illustrates the assembly in the deployed position at a building/structure abutment

As shown in FIGS. 4 and 5 the deadman 113 is comprised of an inner core wrapped by a flexible wall webbing, 115, flexible wall membrane 116, The inner core provides strength and a geometric feature that can't be compressed through the clamping systems. The webbing 115 is an extension of the webbing structure of the flexible wall 101. The webbings wrap around the inner core and are sewn to create a loop. This junction provides a path for loads from the flexible wall 101 to the mounting plate 104 and subsequently the trench 102. The mounting plate 104 may or may not be physically connected to the trench 102. A protective covering 117 may be added to improve resiliency to the flexible wall 101 if rough handling or impacts are anticipated. The webbings 115 can be joined at regular intervals via stitching, sealing, bonding or some similar activity, The webbing 115 can be coated or impregnated with plastic or elastomeric coatings, Or is can be uncoated. The membrane 116 is positioned adjacent to the webbing 115 assembly and is oversized to ensure load transfer in the webbing 115 assembly. The membrane 116 prevents water transmission past the flexible wall 101. The membrane can be any number of materials including polymer coated fabrics, elastomeric sheets, plastic films, etc. The flexible wall is comprised of at least one member selected from the group consisting of fabric, webbings, straps, belts, tapes and combinations thereof, for structural support. Each member of the group consisting of fabric, webbings, straps, belts, tapes and combinations thereof can be woven such that it provides damage tolerance via friction, even if a portion of a single member, or combination of members, are damaged. At least one member selected from the group consisting of fabric, webbings, straps, belts, tapes is connected to another member by at least one of stitching, welding, bonding and combinations thereof. The posts have an element that attaches from the post top to the trench and creates a channel for supporting the flexible wall during and after deployment in wind. The element that attaches from the post top to the trench can be a cable. The posts are constructed from at least one material from the group consisting of metal, plastic, combinations thereof and composite materials. The posts can be of any cross-sectional shape and have a longitudinal shape which is at least one selected from the group consisting of straight and tapered shapes.

Figure 8:
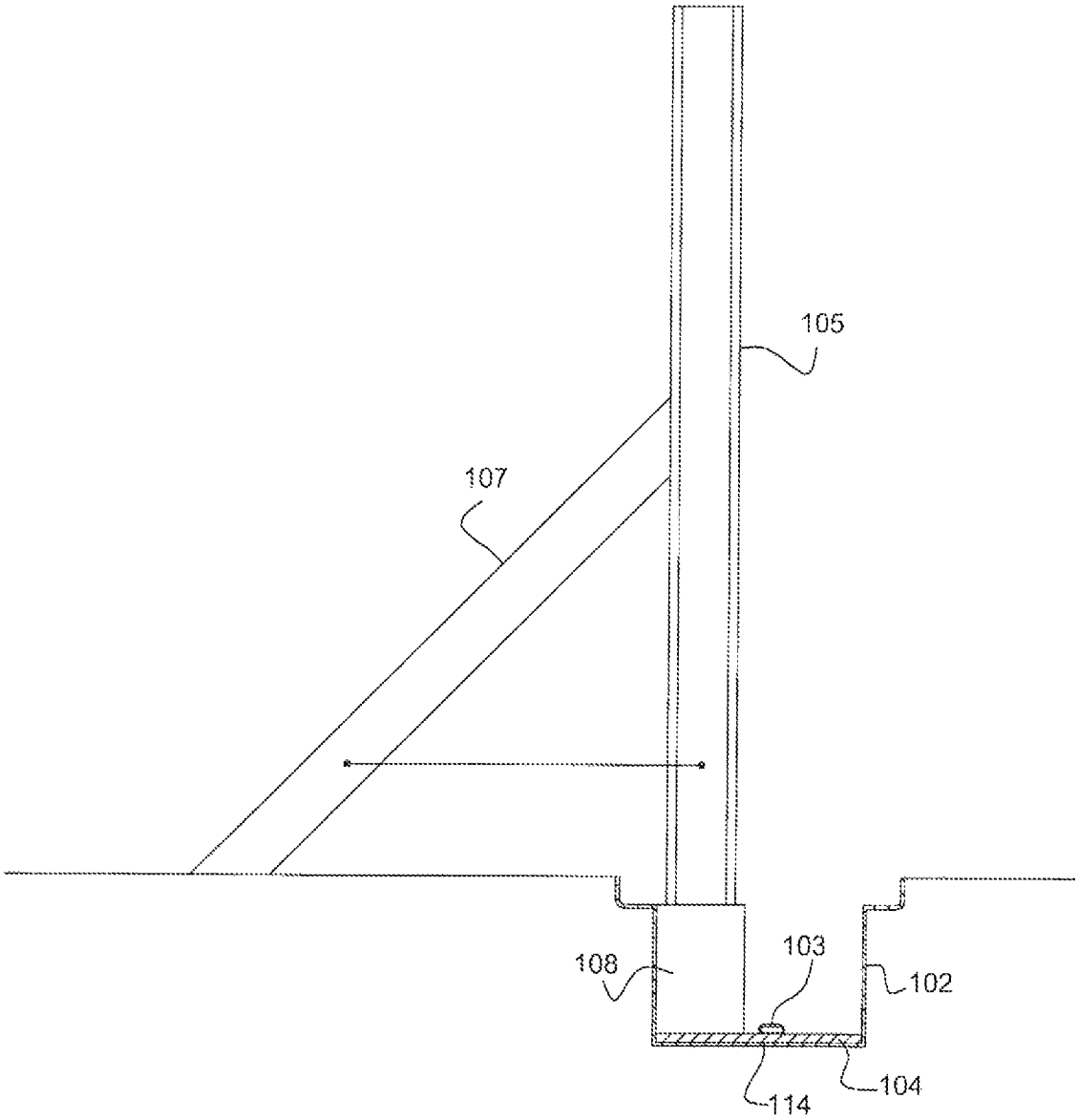
FIG. 8 illustrates the assembly in the deployed position with a buttress

FIG. 8 illustrates that for more highly stressed walls that resist higher water threats or impacts, a buttress 107 can be added to the post 105. This will reduce the bending loads in the posts 105 to keep them small and manageable, and reduce the torsional load in the trench 102 and allow it to be smaller.

We claim:

1. A deployable flexible fluid retention wall system comprising:

a membrane flexible wall; the flexible wall comprising at least a lower end thereof;

a series of rigid posts that support the flexible wall;

a trench; a cover for the trench;

each of the series of posts being initially contained within the trench and beneath the cover when the posts are in a stowed position such that the posts are protected from exposure to the environment by the cover for the trench; the posts comprising a quadrilateral exterior surface on at least a lower end of each post;

the trench further comprising a mounting plate at the bottom of the trench; and the mounting plate additionally comprising a plurality of receivers, each receiver being integral with the mounting plate and quadrilateral in shape, and sized so as to receive the lower quadrilateral end of the post when the post is in its deployed position and which receiver is also protected from exposure to the environment by the cover for the trench; and, a clamping bar and seal;

wherein the flexible wall is attached to the posts and the lower end of the flexible wall being attached between the clamping bar and the seal to the mounting plate within the trench to prevent the passage of fluid beyond the flexible wall.

2. The deployable flexible wall system of claim 1, wherein the flexible wall is comprised of one selected from the group consisting of one and multiple layers of material, wherein said one or multiple layers of material provide fluid retention and structural support to restrain static and dynamic fluid pressure, and floating debris impacts.

3. The deployable flexible wall system of claim 2, wherein the flexible wall is concavely shaped to reduce stress in the flexible wall.

4. The deployable flexible wall system of claim 2, wherein the flexible wall is comprised of a least one member selected from the group consisting of fabric, webbing, straps, belts, tapes and combinations thereof, for structural support.

5. The deployable flexible wall system of claim 4, wherein at least member of the group consisting of fabric, webbings, straps, belts, tapes and combinations thereof is woven.

6. The deployable flexible wall system of claim 4, wherein at least one member selected from the group consisting of fabric, webbings, straps, belts and tapes is connected to at least one other member of the group consisting of fabric, webbings, straps, belts and tapes by at least one of stitching, welding, bonding and combinations thereof.

7. The deployable flexible wall system of claim 2, wherein the flexible wall is comprised of a coated fabric or membrane for fluid retention.

8. The deployable flexible wall system of claim 2, wherein one or more additional layers of fabric is included to provide resiliency or redundancy.

9. The deployable flexible wall system of claim 2, wherein at least some of the perimeter of the flexible wall is comprised of a deadman which is connected to the flexible wall by surrounding the deadman with at least one selected from the group consisting of said one layer and multiple layers of material that provide structural support and fluid retention.

10. The deployable flexible wall system of claim 9, wherein the deadman is comprised of a flexible rope, cable, or assembly of flexible material.

11. The deployable flexible wall system of claim 9, wherein the deadman transmits the load from the flexible wall into at least one selected from the group consisting of the posts and mounting plate.

12. The deployable flexible wall system of claim 2, wherein the flexible nature of the flexible wall facilitates at least one of rolling, folding and combinations thereof, of the flexible wall for storage.

13. The deployable flexible wall system of claim 1, wherein the posts are removable from the receivers for storage in the trench beneath the cover.

14. The deployable flexible wall system of claim 1, further comprising at least one clamping post wherein one or more posts and the clamping post are situated together to clamp the flexible wall and react to loading.

15. The deployable flexible wall system of claim 1, wherein the posts are constructed from at least one material from the group consisting of metal, plastic and combinations thereof.

16. The deployable flexible wall system of claim 1, wherein the posts are angled.

17. The deployable flexible wall system of claim 1, wherein the posts are buttressed.

18. The deployable flexible wall system of claim 1, wherein the flexible wall is configurable to be positioned in any orientation to surround a building or structure of any shape.

19. The deployable flexible wall system of claim 1, wherein the flexible wall is terminated and sealed at a post location.

20. The deployable flexible wall system of claim 1, where the flexible wall is sealed against a structure, building or opening in a building.

21. The deployable flexible wall system of claim 20, wherein the opening in the building is at least one selected from the group consisting of a door and a window.

22. The deployable flexible wall system of claim 1, wherein the flexible wall is stored below ground in the trench and below the cover to protect the flexible wall from exposure to the environment when not deployed.

23. The deployable flexible wall system of claim 1, wherein the flexible wall is used to guide the flow of people or vehicles.

24. The deployable flexible wall system of claim 1, wherein the lower end of the flexible wall comprises a deadman and the deadman prevents pull-out of the flexible wall from the clamping bar under load.

25. The deployable flexible wall system of claim 1, wherein the flexible wall is used to stop the flow of liquid.

26. A deployable flexible fluid retention wall system comprising:

a membrane flexible wall; a series of rigid posts that support the flexible wall;

at least one clamping post;

a trench and a cover for the trench;

each of the series of posts, and the at least one clamping post, being initially contained within the trench and beneath the cover when the posts and the at least one clamping post, are in a stowed position such that the posts and the at least one clamping post are protected from exposure to the environment by the cover for the trench; the posts comprising a quadrilateral exterior surface on at least a lower end of each post;

the trench further comprising a mounting plate at the bottom of the trench; and the mounting plate additionally comprising a plurality of receivers, each receiver being integral with the mounting plate and quadrilateral in shape, and sized so as to receive the lower quadrilateral end of the post when the post is in its deployed position and which receiver is also protected from exposure to the environment by the cover for the trench;

the trench being sized and shaped so as to stow the membrane flexible wall, the series of rigid posts and the at least one clamping post in the trench beneath the cover for the trench when the membrane flexible wall is not deployed;

a clamping bar and a seal; a lower end of the flexible wall being attached between the clamping bar and seal to the mounting plate; and, a gasket seal; the gasket seal being on the at least one clamping post;

whereby a portion of the flexible wall is also clamped between at least one of said rigid posts and the at least one clamping post.

27. The deployable flexible wall system of claim 26, wherein the lower end of the flexible wall comprises a deadman and the deadman prevents pull-out of the flexible wall from the clamping bar under load.

* * * * *